US005813849A

United States Patent [19]

Schwartz et al.

[11] Patent Number: 5,813,849

[45] Date of Patent: Sep. 29, 1998

[54] FLAME DETECTION APPARATUS AND METHODS

[75] Inventors: Robert E. Schwartz; Lawrence D. Berg, both of Tulsa, Okla.

[73] Assignee: John Zink Company, A Division of Koch-Glitshc, Inc., Tulsa, Okla.

[21] Appl. No.: 693,419

[22] Filed: Aug. 7, 1996

[51] Int. Cl.[6] ..... F23D 13/20

[52] U.S. Cl. ..... 431/202; 431/18; 431/74; 431/75

[58] Field of Search ..... 431/202, 74, 75, 431/78, 12, 154, 155, 18

[56] References Cited

U.S. PATENT DOCUMENTS

| | | | |
|---|---|---|---|
| 2,767,783 | 10/1956 | Rowell et al. | 431/75 |
| 2,966,209 | 12/1960 | Pegrum | 431/75 |
| 3,635,018 | 1/1972 | De Corso et al. | 60/39.09 R |
| 3,811,816 | 5/1974 | Whitman | 431/75 |
| 3,833,336 | 9/1974 | Ray | 431/202 |
| 3,932,111 | 1/1976 | Liknes et al. | 431/202 |
| 4,538,979 | 9/1985 | Bertrand | 431/12 |
| 4,626,191 | 12/1986 | Bertrand | 431/12 |
| 5,120,214 | 6/1992 | West et al. | 431/12 |
| 5,472,337 | 12/1995 | Guerra | 431/78 |

OTHER PUBLICATIONS

NASA Langley Research Center Publication Entitled "Acoustic Flame–Out Detector", (Date Unknown).

*Primary Examiner*—James C. Yeung
*Attorney, Agent, or Firm*—McAfee & Taft

[57] ABSTRACT

The present invention provides improved acoustic flame detection apparatus and methods for detecting the presence or non-presence of a flame from a location remote from the flame. The flame detection apparatus is comprised of a conduit extending between the location of the flame to be detected and the remote location, a sound detector connected to the conduit for detecting sound conducted to it by the conduit and generating a signal representative thereof and means for receiving the signal and indicating the presence or non-presence of the flame in response thereto.

22 Claims, 3 Drawing Sheets

FLAME DETECTION APPARATUS AND METHODS

BACKGROUND OF THE INVENTION

1. Field of the Invention.

The present invention relates to improved flame detection apparatus and methods for detecting the presence or non-presence of a flame from a location remote from the flame.

2. Description of the Prior Art.

A variety of apparatus for burning combustible fluid streams have been developed and used heretofore. For example, various types and kinds of burners for combusting fuel and air mixtures to provide heat have been developed. Generally, such burners include one or more pilot burners (often referred to as pilot lights) for igniting the fuel and air mixture when the burner is operated. In some applications, such burners are operated intermittently and the pilot burner is operated continuously to provide ignition each time the burner comes on. In order to prevent explosions or the like when the pilot burner malfunctions and an ignition flame is not provided, pilot flame detection apparatus have been utilized. The detection apparatus is commonly set up to operate in conjunction with the burner controls whereby the fuel to the burner is shut off and the burner is prevented from operating if a pilot flame is not present.

Other burners which are used for combusting and disposing of combustible wastes and other materials are often referred to as flares or flare stacks. Flare stacks are commonly located at production, refining and processing plants for disposing of combustible wastes or other combustible streams which are diverted during venting, shut downs, upsets and/or emergencies.

Flares generally also include continuously operated pilot burners and flame detection apparatus which are often located at the elevated open discharge ends of the flares at the tops of stacks. Because of the heights of such flare stacks and the high temperatures experienced during flaring, failures of the heretofore utilized flame detection apparatus have often occurred and have been relatively difficult to repair and replace.

One prior art flame detection system for flares which has been commonly used heretofore includes a thermocouple for generating a thermoelectric current when heated by a pilot flame. When the pilot flame is not present, less thermoelectric current is generated which is electronically sensed and an alarm is indicated.

Optical systems have heretofore also been developed for use with flare stacks which are mounted on the ground and detect the presence or non-presence of flame at the top of the flare stacks. However, such systems are susceptible to false readings as a result of varying weather conditions and the like. In addition, they may not distinguish between the pilot or pilots and the main flame.

Other infrared, ultraviolet, optical and acoustical flame detection devices have been developed and used with burners and flares, but like the devices utilizing thermocouples they must be mounted relatively close to the flame being detected to be effective, i.e., within a few feet thereof, are subject to rapid deterioration due to intense heat and are difficult to repair or replace.

Thus, there is a need for improved flame detection apparatus for detecting the presence or non-presence of a flame at a location remote from the flame which is reliable, is not subjected to intense heat, is not difficult to repair or replace, etc.

SUMMARY OF THE INVENTION

The present invention provides improved flame detection apparatus and methods which meet the needs described above and overcome the deficiencies of the prior art. The flame detection apparatus of this invention can be located a relatively long distance from the flame being monitored whereby it is not subjected to intense heat, is resistant to changing weather conditions and can easily be serviced or replaced.

The flame detection apparatus of this invention is basically comprised of a conduit having an end thereof positioned with respect to the flame whereby sound produced by the flame is conducted by the conduit. A sound detector is connected to the conduit positioned at a location remote from the flame, i.e., a location in the range of from about 3 feet from the flame to about 600 feet or more from the flame. The sound detector detects sound produced by the flame and conducted by the conduit and generates an electric signal representative of the sound. Electronic means are provided for receiving the electric signal and for indicating the presence or non-presence of the flame in response thereto.

The methods of this invention basically comprise the steps of conducting sound from the location of the flame being monitored to a remote location; detecting the sound at the remote location and producing an electric signal representative thereof; and electronically indicating the presence or non-presence of the flame from the electric signal representative of the sound.

While the improved acoustic flame detection apparatus and methods of this invention can be used for detecting the presence or non-presence of any flame including pilot burner flames, process burner flames and the like from a location remote from the flames, they are particularly suitable for use in applications involving relatively long distances between the locations of the flames and the remote locations of the flame detector such as flare stack applications. Most flare stacks include conduits for conducting fuel-air mixtures to one or more pilot burners positioned at the open discharge ends thereof and often also include conduits extending from ground level to the pilot burners for igniting the pilot burners. Those pilot burner fuel-air mixture and ignition conduits can conveniently also be used to conduct sound from the pilot burners to remote locations where flame detector assemblies of this invention are mounted.

It is, therefore, a general object of the present invention to provide improved flame detection apparatus and methods.

A further object of the present invention is the provision of improved flame detection apparatus and methods for detecting the presence or non-presence of a flame at a location remote from the flame.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 9 is a partial side elevational view of the flare stack of FIG. 1 wherein like numerals designate like parts showing yet another alternate arrangement of the flame detection apparatus of the present invention.

DESCRIPTION OF PREFERRED EMBODIMENTS

Figure 1:
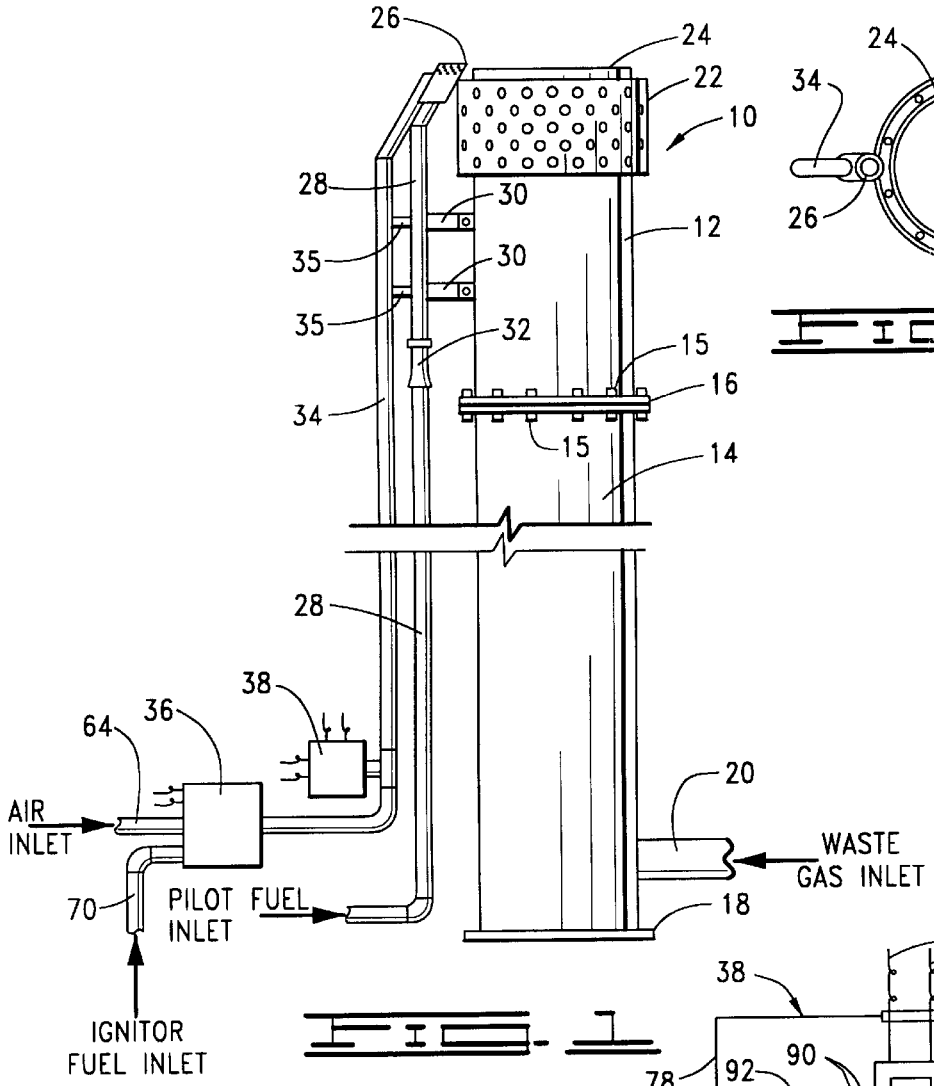
FIG. 1 is a side elevational view of a flare stack including the flame detection apparatus of the present invention.
Figure 2:
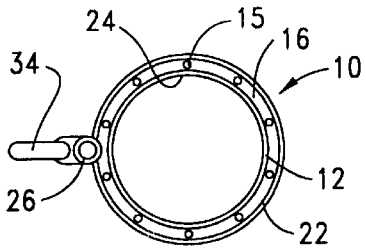
FIG. 2 is a top plan view of the flare stack of FIG. 1.

Referring now to the drawings, and particularly FIGS. 1 and 2, a flare stack including the improved flame detection apparatus of the present invention is illustrated and generally designated by the numeral 10. The flare stack 10 includes a flare 12 and stack 14 which are bolted together by a plurality of bolts 15 at a flanged connection 16. While the heights of flare stacks vary depending upon various factors, most flare stacks utilized in production, refining and processing plants range in height from about 20 feet to as high as about 600 feet. The bottom end of the stack 14 is closed by a ground level base plate 18 and one or more waste gas inlet pipes 20 located at or near ground level are connected to the stack 14. As mentioned above, most flare stacks are operated intermittently for disposing of combustible wastes or other combustible material streams such as hydrocarbon streams which are diverted during venting, shutdowns upsets and/or emergencies.

The flare 12 (also sometimes referred to as a flare tip) may include a cylindrical perforated wind deflector 22 attached thereto adjacent to the upper open discharge end 24 of the flare 12 and at least one pilot burner 26 positioned adjacent the open discharge end 24. As mentioned, the pilot burner 26 is usually operated continuously to provide a continuous flame for igniting streams of combustible gases which are intermittently flowed to the flare stack 10.

Referring still to FIGS. 1 and 2, the pilot burner 26 which will be described further hereinbelow, is connected to a conduit or pipe 28 which extends from the pilot burner 26 at the top of the flare 12 to near ground level and is attached to the flare 12 by a plurality of brackets 30. A conventional fuel-air mixer 32 is disposed in the pipe 28 near the flanged connection 16 between the flare 12 and stack 14, and the pipe 28 is connected to a source of combustible fuel gas such as methane or the like. As is well understood by those skilled in the art, the fuel gas is mixed with inspirated air as it flows through the mixer 32, the mixture flows through the pipe 28 above the mixer 32 to the pilot burner 26 and is burned within and adjacent to the pilot burner 26.

A second conduit or pipe 34 is provided which extends from the pilot burner 26 to a location at or near ground level and is attached to the pipe 28 by a plurality of brackets 35. The pipe 34 is connected at its upper end to the pilot burner 26 as will be further described and to an ignition flame generator 36 at its lower end. In addition, a flame detector assembly of this invention, designated by the numeral 38, is connected to the pipe 34 near ground level between the ignition flame generator 36 and the pilot burner 26.

The pilot burner 26 is ignited by flowing a combustible fuel and air mixture through the pilot burner 26 and then operating the ignition flame generator 36 to produce a flame which is propagated through the pipe 34 to the pilot burner 26. When the ignition flame exits the pipe 34, it ignites the fuel-air mixture flowing from the pilot burner 26. After the pilot burner 26 is ignited, the ignition flame generator 36 is shut off.

As will be described further herein, the sound produced by the flame (not shown) of the pilot burner 26 is conducted by the pipe 34 to the flame detector assembly 38 connected thereto. The flame detector assembly 38 continuously indirectly detects the presence or non-presence of the flame at the pilot burner 26 from its location remote from the pilot burner 26 by detecting the presence or non-presence of the flame sound conducted by the pipe 34. If the flame of the pilot burner 26 is extinguished for any reason, the flame detector assembly 38 provides a warning such as a light and/or audible alarm so that the pilot burner 26 can immediately be reignited. As will be understood by those skilled in the art, the ignition flame generator 36 can be set up to be electronically operated each time the flame detector assembly 38 detects the non-presence of a flame at the pilot burner 26.

Figure 5:
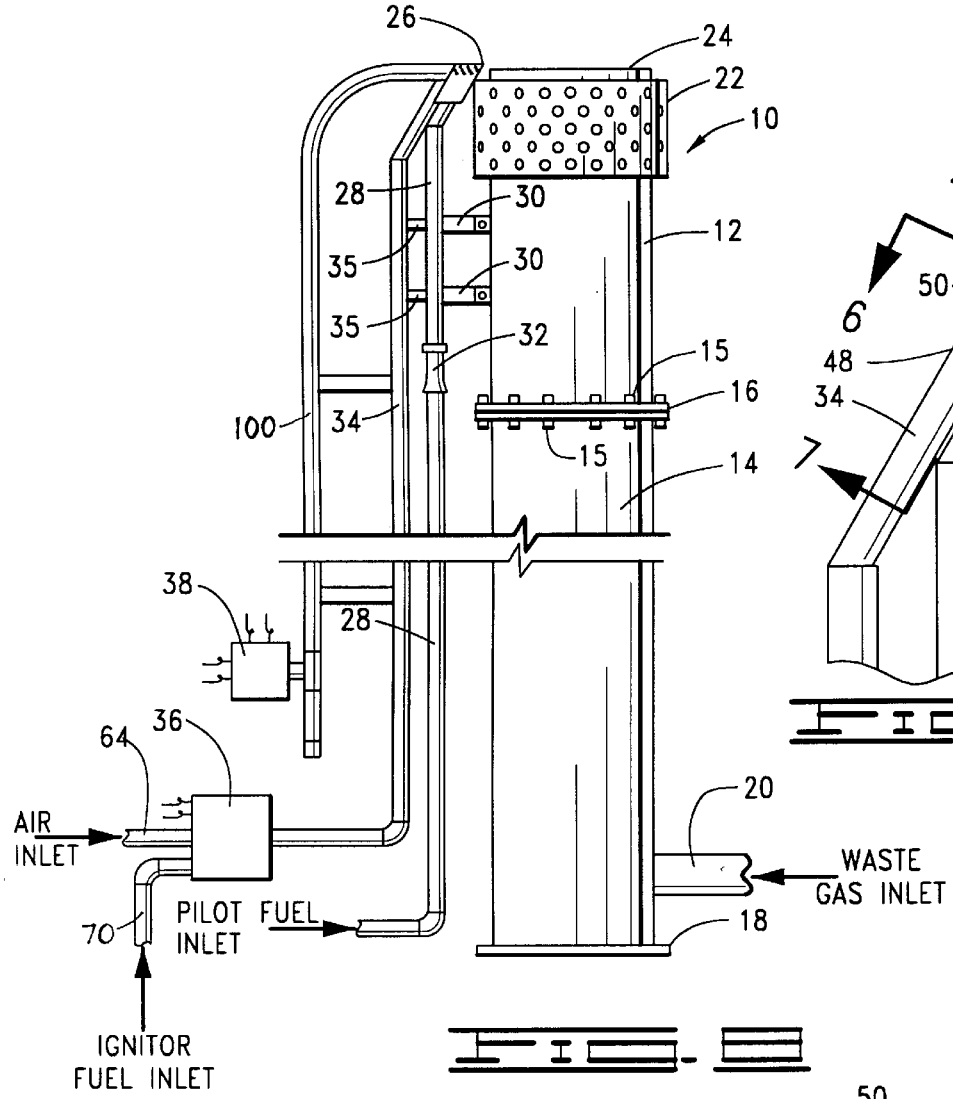
FIG. 5 is an enlarged view of the pilot burner and sound conducting conduit illustrated in FIG. 1.
Figure 5:
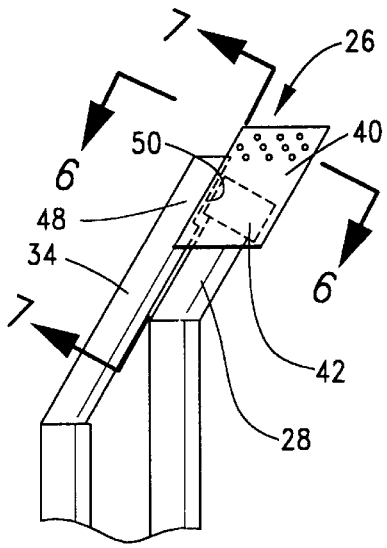
Figure 7:
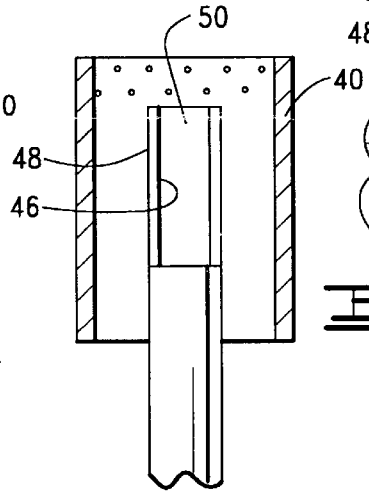
FIG. 7 is a cross-sectional view taken along lines 7—7 of FIG. 5.
Figure 6:
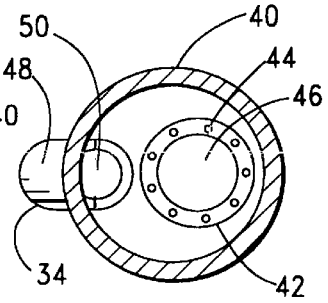
FIG. 6 is a cross-sectional view taken along lines 6—6 of FIG. 5.

Referring now to FIGS. 5–7, the pilot burner 26 and the upper end portions of the pipes 28 and 34 are illustrated in detail. The pilot burner 26 is comprised of a cylindrical perforated wind shield 40 which is attached to a conventional pilot burner nozzle (or tip) 42 which is in turn attached to the pipe 28. The nozzle 42 includes one or more fuel-air mixture discharge orifices 44 therein for discharging the fuel-air mixture in a pattern which produces a stable pilot flame.

As best shown in FIG. 7, the cylindrical wind shield 40 includes a side opening formed therein within which the top end portion 48 of the pipe 34 is welded. An elongated end segment of the pipe 34 within the wind shield 40 is removed and the top end of the pipe 34 outside the wind shield 40 is closed whereby the pipe 34 opens into the wind shield 40 by way of an opening 50 extending below, beside and above the nozzle 42.

As will be understood, a variety of pilot burner 26 and flame sound-conducting pipe 34 designs and arrangements can be made by those skilled in the art which differ from the presently preferred design and arrangement described above without departing from the present invention. It is only necessary that the sound produced by the presence of a flame be conducted to the remote location where the flame detector assembly 38 of this invention is mounted.

Figure 3:
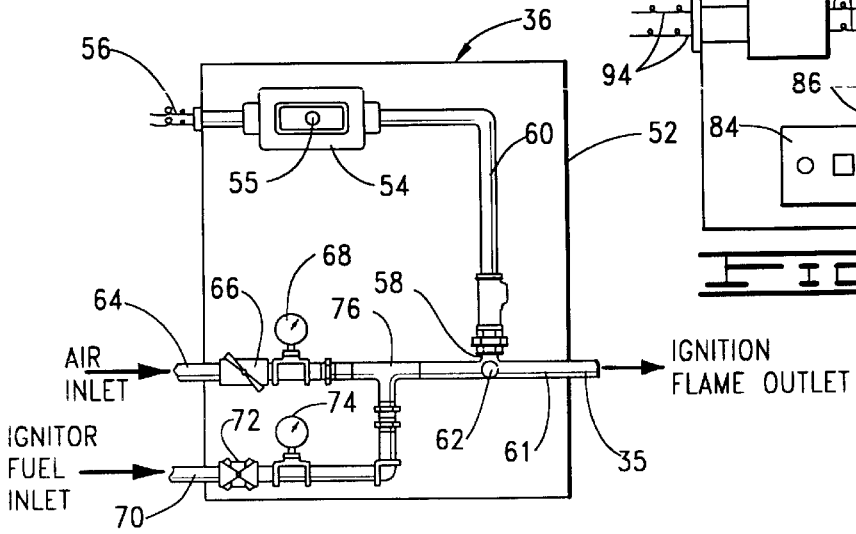
FIG. 3 is an enlarged schematic view of the pilot burner ignition flame generator shown in FIG. 1.

Referring now to FIG. 3, the ignition flame generator 36 is illustrated in detail. The ignition flame generator 36 includes a plate 52 upon which a transformer 54 is located connected to an electric power source (not shown) by wires 56. The transformer 54 is connected to an enclosed spark plug 58 by wires contained within an electric wire conduit 60. The enclosed spark plug 58 is connected to a fuel-air ignition chamber 61 having a sight glass 62 therein. The chamber 61 is connected to an air inlet conduit 64 having a shut-off valve 66 and a pressure gage 68 disposed therein and to an ignitor fuel gas conduit 70 having a shut-off valve 72 and pressure gage 74 disposed therein by way of a T-connection 76.

In operation of the ignitor flame generator 36, a combustible fuel gas-air mixture is flowed to the pilot burner 26 by way of the conduit 28. The valves 66 and 72 of the ignitor flame generator 36 are then opened to produce a combustible fuel gas-air mixture which flows into the chamber 61 and through the conduit 34 to the pilot burner 26. The transformer 54 is operated by pushing the button 55 thereon to spark the spark plug 58 and ignite the fuel gas-air mixture flowing through the chamber 61. The sight glass 62 provides a visual indication of the ignition. The flame produced within the chamber 61 is propagated through the conduit 34 to the pilot burner 26. That is, the flame flows through the opening 50 of the conduit 34 within the wind shield 40 of the pilot burner 26 whereby the fuel gas-air mixture being discharge by the nozzle 42 is ignited. After the ignition of the pilot burner 26 has been accomplished, the valves 66 and 72 of the ignition flame generator 36 are closed.

Figure 4:
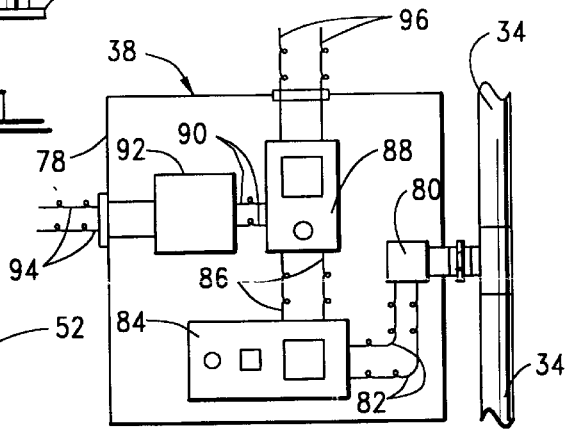
FIG. 4 is an enlarged schematic view of the flame detector of the present invention illustrated in FIG. 1.

Referring now to FIG. 4, the flame detector assembly 38 is illustrated in detail. The flame detector assembly 38 is enclosed in a housing 78 and includes a sound detector 80 which is sealingly connected to the conduit 34. The sound detector 80 is an electronic acoustic vibration receiver such as a microphone, a piezoelectric crystal, a geophone or the like. The electronic acoustic vibration receiver 80 converts the sound conducted to it by the conduit 34 to an electric signal which is conducted to an electronic network 84 by wires 82. The electronic network 84 filters the electric signal to a signal representative of one or more preselected frequency bands. The preselected frequency band signal is then conducted to an electronic energy detecting circuit 88 by wires 86. The energy detecting circuit 88 determines the energy content of the electric signal at the preselected frequency band or bands to thereby indicate the presence or non-presence of the pilot burner flame. That is, if the energy content of the signal is equal to or higher than a predetermined energy content for the preselected frequency band or bands, the presence of flame is indicated. If lower, the non-presence of the flame is indicated.

As will be understood by those skilled in the art, various other techniques can be used to electronically analyze the signal produced by the acoustic vibration receiver in order to detect the presence or non-presence of the flame. For example, the signal can be analyzed to determine the presence or non-presence of an energy peak at a preselected frequency band or bands; or the shape of a plot of the signal frequency versus energy can be compared to a standard plot indicating the presence of flame; or the rate of change of the frequency versus energy in a preselected frequency band or bands can be compared to the rate of change when a flame is present.

Electric power is provided to the electronic components 84 and 88 by a transformer 92 connected to an electric power supply (not shown) by wires 94 and to the electronic component 88 by wires 90. The presence or non-presence of the pilot burner flame is indicated by the electronic component 88 by an electric signal which is conducted by wires 96 to an alarm and/or other electronic system, e.g., a system for automatically operating the ignition flame generator 36.

Thus, the flame detection apparatus of the present invention is basically comprised of the pipe 34 and the flame detector assembly 38. An end of the pipe 34 is positioned with respect to the flame issued from the pilot burner 26 whereby sound made by the flame is conducted by the pipe 34 to the sound detector 80 of the flame detector assembly 38 which is connected to the pipe 34 at a location remote from the pilot burner flame. The terms "location remote from said flame" and "remote location" are used herein to mean a location which is a distance from the flame being monitored in the range of from about 3 feet to about 600 feet and greater.

The methods of the present invention for detecting the presence or non-presence of a flame at a location remote from the location of the flame basically comprise the steps of conducting sound from the location of the flame to a location remote from the flame; detecting the sound at the remote location and producing a signal representative of the sound; and indicating the presence or non-presence of the flame from the signal representative of the sound. Preferably, the signal is an electric signal and the presence or non-presence of the flame is electronically indicated from the electric signal. As mentioned above, in carrying out the step of indicating the presence or non-presence of the flame electronically or otherwise from an electric or other signal, e.g., microwave, light wave, etc., generated by the sound detector, various techniques which are known to or can be devised by those skilled in the art can be utilized.

Figure 8:
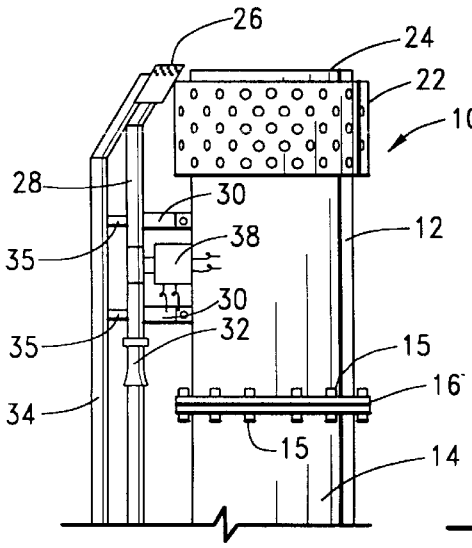
FIG. 8 is a side elevational view of the flare stack of FIG. 1 wherein like numerals designate like parts showing an alternate arrangement of the flame detection apparatus of the present invention.

As will also be understood by those skilled in the art, the improved flame detection apparatus and methods of this invention can be utilized with flare stacks or other burners which do not include ignition flame generators and separate conduits for conducting ignition flames to the burners or pilot burners thereof. In those applications where an existing conduit for conducting sound to the detection apparatus is not available, an additional conduit for conducting the sound can be installed. Also, as illustrated in FIG. 8, if for some reason it is undesirable to utilize the ignition flame generator conduit 34 for conducting flame sound, a separate conduit 100 can be installed and the flame detector assembly 38 can be connected to it as shown.

In another alternate arrangement as shown in FIG. 9, if an existing ignition flame conduit is unavailable and if installing an additional conduit is undesirable, the flame detector assembly 38 can be connected to the pipe 28 at a remote location from the flame of the pilot burner 26 above the fuel-air mixer 32. While the fuel-air mixture for the pilot burner 26 flows through that portion of the pipe 28, the flame detector assembly 38 is still capable of detecting the presence or non-presence of flame sound and determining the presence or non-presence of flame at the pilot burner.

Figure 10:
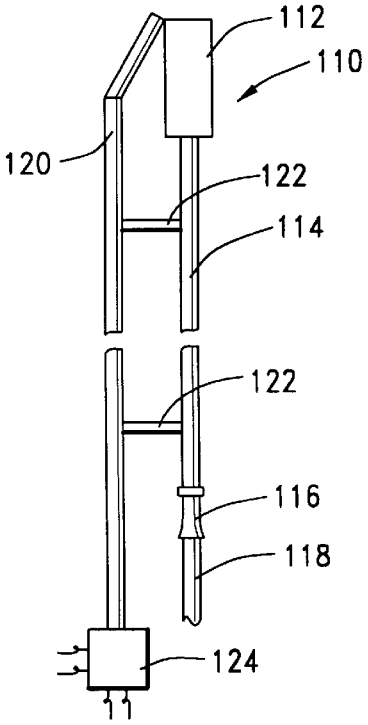
FIG. 10 is a side view of a pilot burner for use in a process burner or the like including the flame detection apparatus of the present invention.

Referring now to FIG. 10, a pilot burner assembly for use in a process burner, boiler burner or the like including the flame detection apparatus of the present invention is illustrated and generally designated by the numeral 110. The apparatus 110 includes a pilot burner tip 112 connected to a fuel-air mixture pipe 114. A fuel-air mixer 116 is connected to the pipe 114 which is in turn connected to a fuel gas supply pipe 118. A flame sound conducting conduit 120 attached to the fuel-air mixture pipe 114 by brackets 122 extends from the pilot flame discharge end of the burner tip 112 to a location remote from the burner tip 112 where a flame detector assembly of the present invention 124 is connected to the conduit 120. In operation of the apparatus of FIG. 10, fuel gas is supplied to the fuel-air mixer 116 and the resulting fuel-air mixture flows by way of the pipe 114 to the burner tip 112 wherein the mixture is discharged and continuously burned. The sound of the flame issuing from the burner tip 112 is conducted by the conduit 120 to the flame detector assembly 124. The flame detector assembly 124 is identical in structure and operation to the flame detector assembly 38 described above.

Figure 11:
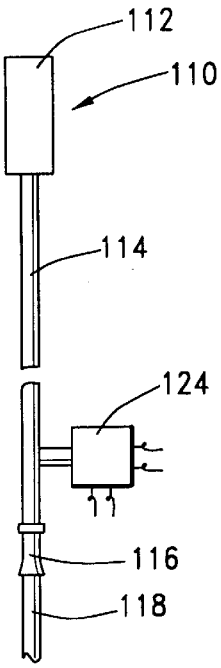
FIG. 11 is a side view of the pilot burner of FIG. 10 wherein like numerals designate like parts illustrating an alternate arrangement of the flame detection apparatus of the present invention.

Referring now to FIG. 11, the pilot burner 110 of FIG. 10 is shown having an alternate arrangement of the flame detection apparatus of the present invention. Instead of being attached to an elongated conduit 120, the flame detector assembly 124 is attached directly to the fuel-air mixture pipe 114. While the fuel-air mixture continuously flows through the pipe 114, the flame detector assembly 124 can still detect the presence or non-presence of a flame issuing from the burner tip.

Figure 12:
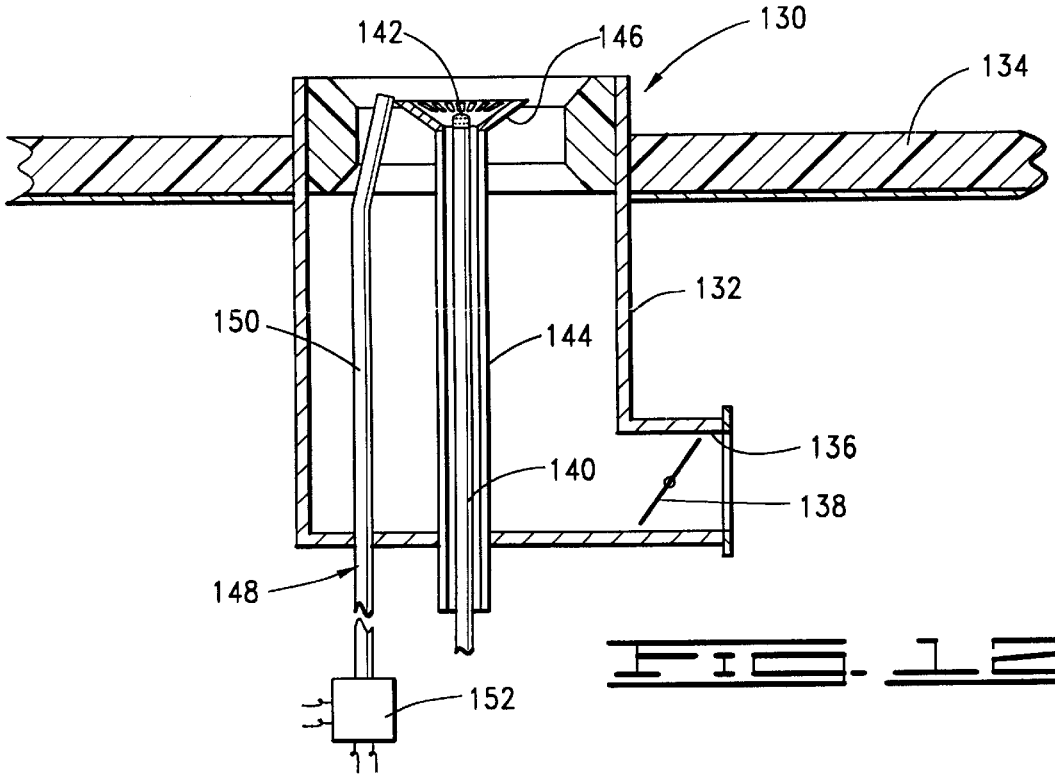
FIG. 12 is a side cross-sectional view of a process burner including the flame detection apparatus of the present invention.

Referring now to FIG. 12, a side cross-sectional view of a process burner including the flame detection apparatus of the present invention is illustrated and generally designated by the numeral 130. The burner 130 includes a burner housing 132 connected through an opening in the insulated wall 134 of a process heater. The housing 132 includes a combustion air inlet 136 having a damper 138 therein. A fuel gas supply pipe 140 having a burner tip 142 connected thereto is disposed within a guide tube 144 attached within the housing 132. The burner tip 142 extends into a flame holder 146 attached to the guide tube 144. Fuel gas which is discharged by way of the burner tip 142 mixes with combustion air flowing through the housing 132 and is combusted within the process heater to which burner 130 is attached.

A flame detection apparatus of the present invention 148 comprised of a flame sound conductor pipe 150 and a flame detector assembly 152 identical in structure and operation to the flame detector assembly 38 described above is attached to the burner 130. That is, the sound conducting pipe 150 is connected through the housing 132 of the burner 130 with the inner end of the pipe 150 positioned adjacent to the flame holder 146. The flame detector assembly 152 is connected to the external end of the pipe 150 at a location remote from the burner flame.

In operation, a fuel-air mixture is discharged from the burner 130 and burned within the furnace to which the burner 130 is attached. The sound of the flame is conducted by the conduit 150 to the remotely positioned flame detector assembly 152 which functions in the manner described above to detect the presence or non-presence of the flame.

While the improved flame detection apparatus and methods of this invention for detecting the presence or non-presence of a flame at a location remote from the flame have principally been described in conjunction with a flare stack, it will be understood that the flame detection apparatus and methods can be utilized to detect and monitor any flame including, but not limited to, flames produced by pilot burners, process burners, boiler burners and any other flame producing burner or device. The term "flame" is used herein to mean any flame or combustion reaction which produces detectible sound. Further, it will be understood by those skilled in the art that the flame detection apparatus of this invention can be utilized with burners that combust liquid fuel as well as gaseous fuel and that any oxidizer such as air, oxygen or other oxidizing substance can be used to support the combustion.

Thus, the present invention is well adapted to carry out the objects and advantages mentioned as well as those which are inherent therein. While numerous changes may be made by those skilled in the art, such changes are encompassed within the spirit of this invention as defined by the appended claims.

What is claimed is:

1. An improved flame detection apparatus for detecting the presence or non-presence of a flame issued from a pilot burner located at the top open discharge end of a flare stack comprising:

a conduit having an end positioned at said open discharge end of said flare stack relative to said flame whereby sound produced by said flame is conducted by said conduit to a location remote from said flame near the bottom of said flare stack;

a sound detector connected to said conduit at said location remote from said flame for detecting sound conducted by said conduit and for generating a signal representative of said sound; and means for receiving said signal and for indicating the presence or non-presence of said flame in response thereto.

2. The apparatus of claim 1 wherein said conduit is a sound-conducting pipe.

3. The apparatus of claim 2 which further comprises an ignition flame generator connected to said sound conducting pipe at said location remote from said flame for producing an ignition flame for igniting said pilot burner that propagates through said pipe to said pilot burner.

4. The apparatus of claim 1 wherein said signal generated by said sound detector is an electric signal.

5. The apparatus of claim 1 wherein said means for receiving said signal and indicating the presence or non-presence of said flame comprises electronic circuitry which determines the energy content of said signal at one or more preselected frequency bands to thereby indicate the presence or non-presence of said flame.

6. The apparatus of claim 1 wherein said means for receiving said signal and indicating the presence or non-presence of said flame comprises electronic circuitry which determines the presence or non-presence of an energy peak in said signal at one or more preselected frequency bands to thereby indicate the presence or non-presence of said flame.

7. The apparatus of claim 1 wherein said means for receiving said signal and indicating the presence or non-presence of said flame comprises electronic circuitry which determines the shape of a plot of the frequency of said signal versus energy and compares said shape with a standard plot to thereby indicate the presence or non-presence of said flame.

8. The apparatus of claim 1 wherein said means for receiving said signal and indicating the presence or non-presence of said flame comprises electronic circuitry which determines the rate of change of the frequency of said signal versus energy at one or more preselected frequency bands to thereby indicate the presence or non-presence of said flame.

9. An improved acoustic flame detection apparatus for detecting the presence or non-presence of a flame from a location remote therefrom, said flame when present being issued from a pilot burner positioned at the open discharge end of a combustible fluid stream flare stack comprising:

a pipe having an end positioned adjacent to said pilot burner and a length whereby sound produced by flame issued from said burner is conducted by said pipe to a location remote from said flame;

a sound detector connected to said pipe at said location remote from said flame for detecting sound conducted by said pipe and for generating an electric signal representative of said sound;

electronic means for receiving said signal and indicating the presence or non-presence of said flame in response thereto; and an ignition flame generator connected to said pipe for producing an ignition flame for igniting said pilot burner that propagates through said pipe to said pilot burner.

10. The apparatus of claim 9 wherein said flare stack is positioned substantially vertically and said remote location is near the bottom thereof.

11. The apparatus of claim 10 wherein said sound detecting means comprises an electronic acoustic vibration receiver.

12. The apparatus of claim 9 wherein said sound detecting means comprises a microphone or a piezoelectric crystal.

13. The apparatus of claim 9 wherein said electronic means comprises electronic circuitry which determines the energy content of said signal at one or more pre-selected frequency bands to thereby indicate the presence or non-presence of said flame.

14. The apparatus of claim 9 wherein said electronic means comprises electronic circuitry which determines the presence or non-presence of an energy peak in said signal at one or more preselected frequency bands to thereby indicate the presence or non-presence of said flame.

15. The apparatus of claim 9 wherein said electronic means comprises electronic circuitry which determines the shape of a plot of the frequency of said signal versus energy and compares the shape with a standard plot to thereby indicate the presence or non-presence of said flame.

16. The apparatus of claim 9 wherein said electronic means comprises electronic circuitry which determines the rate of change of the frequency of said signal versus energy at one or more preselected frequency bands to thereby indicate the presence or non-presence of said flame.

17. A method of detecting the presence or non-presence of a flame issued from a pilot burner located at the open discharge end of a flare stack comprising the steps of:

conducting sound produced by said flame through a conduit from the location of said flame to a location remote from said flame near the bottom of said flare stack;

detecting the sound at said location remote from said flame and producing a signal representative of said sound; and indicating the presence or non-presence of said flame from said signal representative of said sound.

18. The method of claim 17 wherein said signal is an electric signal and the presence or non-presence of said flame is electronically determined from said electric signal.

19. The method of claim 17 which further comprises the step of igniting said pilot burner when required by generating an ignition flame and propagating it through said conduit to said pilot burner.

20. The method of claim 17 wherein said conduit is a pipe extending from the location of said pilot burner flame to said remote location.

21. The method of claim 17 wherein said sound is detected at said remote location and an electric signal produced representative thereof by an electronic acoustic vibration receiver connected to said conduit.

22. The method of claim 21 wherein said electric acoustic vibration receiver is a microphone or a piezoelectric crystal.

* * * * *

UNITED STATES PATENT AND TRADEMARK OFFICE

CERTIFICATE OF CORRECTION

PATENT NO. : 5,813,849

DATED : September 29, 1998

INVENTOR(S) : Robert E. Schwartz, Lawrence D. Berg and Wesley R. Bussman

It is certified that error appears in the above-identified patent and that said Letters Patent is hereby corrected as shown below:

On the title page, item [75], before "both" add --Wesley R. Bussman--; and change "both" to --all--.

On the title page, item [73], change "Glitsch" to --Glitsch--.

Signed and Sealed this

Nineteenth Day of January, 1999

*Attest:*

*Attesting Officer*

*Acting Commissioner of Patents and Trademarks*